US008881847B2

(12) United States Patent
Swope et al.

(10) Patent No.: US 8,881,847 B2
(45) Date of Patent: Nov. 11, 2014

(54) DUST COLLECTING DEVICE FOR A ROOF TOOL

(75) Inventors: Chad Allen Swope, Bedford, PA (US); Douglas Edward Bise, Chilhowie, VA (US)

(73) Assignee: Kennametal Inc., Latrobe, PA (US)

( * ) Notice: Subject to any disclaimer, the term of this patent is extended or adjusted under 35 U.S.C. 154(b) by 420 days.

(21) Appl. No.: 13/014,743

(22) Filed: Jan. 27, 2011

(65) Prior Publication Data

US 2012/0024607 A1 Feb. 2, 2012

Related U.S. Application Data

(60) Provisional application No. 61/299,479, filed on Jan. 29, 2010.

(51) Int. Cl.
*E21B 21/015* (2006.01)
*E21D 20/00* (2006.01)

(52) U.S. Cl.
CPC ..... *E21B 21/015* (2013.01); *E21D 20/003* (2013.01)
USPC ..... 175/209; 175/417; 175/418; 408/67

(58) Field of Classification Search
CPC B23Q 11/0046; B23Q 11/0071; E21B 10/36; E21B 10/38; E21B 17/04; E21B 10/52; E21B 10/54; E21B 3/02; B25F 5/00
USPC ..... 175/417, 418, 419, 420.1; 408/67; 173/217, 197
See application file for complete search history.

(56) References Cited

U.S. PATENT DOCUMENTS

| | | | | | |
|---|---|---|---|---|---|
| 2,792,199 | A | * | 5/1957 | Becker et al. | 175/211 |
| 2,870,993 | A | * | 1/1959 | Jahnke | 175/209 |
| 3,554,306 | A | | 1/1971 | Wilburn | |
| 3,936,213 | A | * | 2/1976 | Kappel | 408/67 |
| 3,960,222 | A | | 6/1976 | Leibee et al. | |
| 4,113,037 | A | * | 9/1978 | Wanner et al. | 175/207 |
| 5,172,775 | A | | 12/1992 | Sheirer et al. | |
| 5,184,689 | A | | 2/1993 | Sheirer et al. | |
| 5,297,643 | A | | 3/1994 | Montgomery, Jr. et al. | |
| 5,325,931 | A | | 7/1994 | Woods | |
| 5,400,861 | A | | 3/1995 | Sheirer | |
| 5,429,199 | A | | 7/1995 | Sheirer et al. | |
| 5,452,628 | A | | 9/1995 | Montgomery, Jr. et al. | |
| 5,467,837 | A | | 11/1995 | Miller et al. | |
| 5,704,438 | A | | 1/1998 | Kloppers et al. | |
| 5,833,017 | A | | 11/1998 | Woods et al. | |
| 5,927,411 | A | | 7/1999 | Sheirer | |
| 6,044,920 | A | | 4/2000 | Massa et al. | |
| 6,086,292 | A | * | 7/2000 | Yokoyama | 408/67 |
| 6,173,798 | B1 | | 1/2001 | Bryant et al. | |

(Continued)

*Primary Examiner* — Shane Bomar
*Assistant Examiner* — Wei Wang
(74) *Attorney, Agent, or Firm* — Matthew W. Smith, Esq.

(57) ABSTRACT

A dust collecting device disposed circumferentially around a roof tool and in association with a roof drill bit and slidable thereon for collecting and removing dust generated during a dry drilling operation. The dust collecting device comprises a cylinder member, a bushing, and a mounting assembly comprising a top washer, a rubber insert, and a bottom washer. Another aspect of the invention provides a dust collecting device comprising a cylinder member, a bushing, and a mounting assembly comprising a disk and clips. The rubber insert and the clips resist movement of the dust collecting device along the drill steel of the roof tool during the drilling operation.

4 Claims, 3 Drawing Sheets

*FIG. 4*

(56) References Cited

U.S. PATENT DOCUMENTS

| | | | |
|---|---|---|---|
| 6,176,332 | B1 | 1/2001 | Massa et al. |
| 6,309,149 | B1 | 10/2001 | Borschert et al. |
| 6,315,064 | B1 | 11/2001 | Massa et al. |
| 6,368,377 | B1 | 4/2002 | Bryant et al. |
| 6,533,049 | B1 | 3/2003 | Rein, Sr. et al. |
| 6,595,305 | B1 | 7/2003 | Dunn et al. |
| 6,598,688 | B2 | 7/2003 | Wang |
| 6,655,882 | B2 | 12/2003 | Heinrich et al. |
| 6,860,344 | B2 | 3/2005 | Bise et al. |
| 6,886,645 | B2 | 5/2005 | Bise et al. |
| 6,915,867 | B2 | 7/2005 | Bise |
| 7,168,511 | B2 | 1/2007 | Woods et al. |
| 7,207,400 | B2 | 4/2007 | Bise et al. |
| 7,476,067 | B2 | 1/2009 | Borschert et al. |
| 7,901,164 | B2 * | 3/2011 | Skradski et al. ..... 408/67 |

* cited by examiner

DUST COLLECTING DEVICE FOR A ROOF TOOL

CROSS REFERENCE TO RELATED APPLICATION

This application claims the benefit of U.S. Provisional Patent Application Ser. No. 61/299,479 filed Jan. 29, 2010, which is fully incorporated herein by reference.

FIELD OF THE INVENTION

The invention pertains to a roof tool for drilling roof bore holes in a mine ceiling for receiving roof bolts. More specifically, the invention pertains to a roof tool comprising a dust collecting device for collecting and/or gathering rock dust during a dry drilling operation.

BACKGROUND

Expansion of an underground mine such as, for example, a coal mine, requires digging a tunnel. Initially this tunnel has an unsupported roof. In order to support and stabilize the roof in an established area in an underground tunnel, bore holes are drilled in the roof. The apparatus used to drill these holes comprises a drill with a long shaft, i.e., drill steel, attached to a drill bit. U.S. Pat. No. 6,533,049 to Rein, Sr. et al. and U.S. Pat. No. 6,598,688 to Wang each show a drill steel that is useful in a roof drill bit assembly for drilling such bore holes. U.S. Pat. No. 3,554,306 to Wilburn shows a drill rod assembly that is useful for drilling roof bolt bore holes.

A roof drill bit is detachably mounted, either directly or through the use of a chuck, to the drill steel at the distal end thereof. U.S. Pat. No. 5,927,411 to Sheirer and U.S. Pat. No. 5,833,017 to Woods et al. each show a roof drill bit assembly. To commence the drilling operation, the roof drill bit is then pressed against the roof and the drilling apparatus is operated so as to drill a bore hole in the roof. The bore holes extend between two feet to greater than twenty feet into the roof. These bore holes are filled with resin and roof bolts are affixed within the bore holes which are used to secure the roof.

There are at least two methods for drilling these roof bolt bore holes. A first method has been a wet drilling method, i.e., a method where a coolant passes through the roof drill bit assembly and impinges upon the cutting inserts and into the area of drilling through fluid passages contained in the forward end of the roof drill bit. U.S. Pat. No. 5,400,861 to Sheirer shows an example of a roof drill bit assembly that can be useful in wet drilling. A second method of drilling these roof bolt bore holes has been the dry drilling method, i.e. drilling the earth strata without using any coolant or the like. In U.S. Pat. No. 6,315,064 to Massa et al., a rotatable cutting bit assembly with cutting inserts includes debris evacuation passages or ports located at the axially forward end of the elongate body of the roof drill bit in close proximity to the cutting inserts for drawing in the earth cuttings to form the roof bolt bore holes.

In a dry drilling operation, a substantial amount of "rock" dust is generated, and released into the surrounding air. When the rock dust becomes airborne and is released into the surrounding air, it becomes a risk for humans and equipment in the immediate area. For example, the rock dust can be inhaled by humans (health risk) or the rock dust can be ignited by mining activities causing an explosion (safety risk).

There is a need to provide a device that collects and/or gathers dust during a dry drilling operation for drilling roof bolt bore holes in an underground coal mine.

There is a further need to provide a device that assists the dust/debris collection system of a roof tool in collecting the initial rock dust that is released into the mine atmosphere during the start of drilling a roof bolt bore hole and prior to the roof tool's entering the roof bolt bore hole being drilled so that the vacuum collecting system of the roof tool can collect the debris and/or the dust generated during the drilling operation.

SUMMARY

An aspect of the present invention is to provide a dust collecting device mounted onto a roof tool comprising a roof drill bit and a drill steel and a dust collecting device slidable thereon for collecting and/or catching the rock dust generated during a dry drilling operation for drilling a roof bolt bore hole in the roof of an underground coal mine. The dust collecting device comprises a cylinder steel member, a bushing, and a mounting assembly for mounting the cylinder member around the outer periphery surface of the shaft of the drill steel. The roof drill bit comprises vacuum ports associated with a vacuum collection system. Advantageously, during use of the invention in a dry drilling operation for forming roof bolt bore holes, a vacuum draws in atmospheric air into an annular area created between the cylinder of the dust collecting device and the drill steel and/or the roof drill bit. This vacuum creates a suction path for drawing the rock dust being collected in the dust collecting device into the vacuum ports of the roof tool and away from the work environment.

In a further aspect of the invention, the dust collecting device may assist in collecting or catching the rock dust that is initially generated during the beginning of the dry drilling operation which is normally released into the mine atmosphere before the roof tool can enter the bore hole being drilled. At a certain point in the drilling operation, the vacuum collection system of the roof tool can then begin to draw in the rock dust along with the strata cuttings via vacuum ports in the roof drill bit.

These and various other features and advantages will be apparent from the following drawings and detailed description.

DRAWINGS

DETAILED DESCRIPTION

Figure 1:
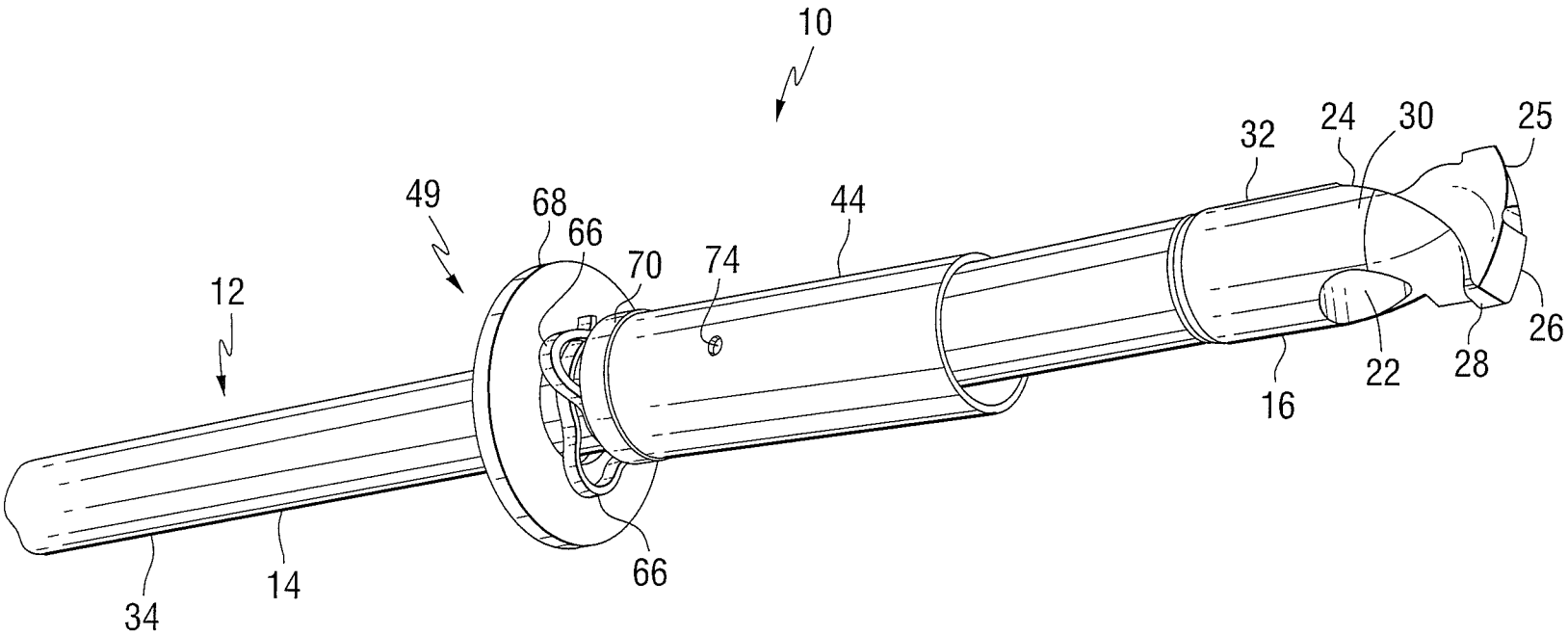
FIG. 1 is a photograph showing a perspective view of a dust collecting device assembled on a drill steel of a roof tool, in accordance with an aspect of the invention.

FIGS. 1, 2, 3 and 4 illustrate a dust collecting device generally designated as 10, in accordance with an aspect of the invention. Dust collecting device 10 is circumferentially disposed around a roof tool, generally designated as 12 and is constructed to move axially along a roof tool 12 as indicated by the double arrow "A" in FIG. 4. Roof tool 12 comprises a drill member 14 or "drill steel" and a roof drill bit 16 (FIGS. 1 and 4) coupled to an upper portion of drill steel 14 in a known manner.

According to common practice, roof tool 12 is a component of a roof drilling machine (not shown) for drilling holes in the rock strata. Even though not shown, drill steel 14 of roof tool 12 is generally coupled on an end opposite to the end with drill bit 16 to a rotary power source via a drill chuck. The rotary power source rotates drill steel 14, and thus roof drill bit 16, to remove strata from a bore hole being drilled in the roof of a coal mine.

The drilling machine incorporates a vacuum suction collection system (not shown) for collecting strata cuttings and/or rock dust generated during the drilling of the bore hole. In general, the diameter of the drill steel 14 and the roof drill bit 16 may range, for example, from about ⅞ inch (22.23 mm) to about 1.625 inches (41.28 mm) in diameter, and the length of the assembled drill steel 14 and roof drill bit 16 may range, for example, from about 1 foot (304.8 mm) to about 12 feet (3657.6 mm). The length of roof tool 12, i.e., the drill bit 16 and drill steel 14, is such that it is capable of extending a required depth up into the mine roof for drilling the bolt bore holes while the dust collecting device 10 remains against the mine roof and is pushed downwardly along drill steel 14 by the mine roof during the drilling operation.

Figure 4:
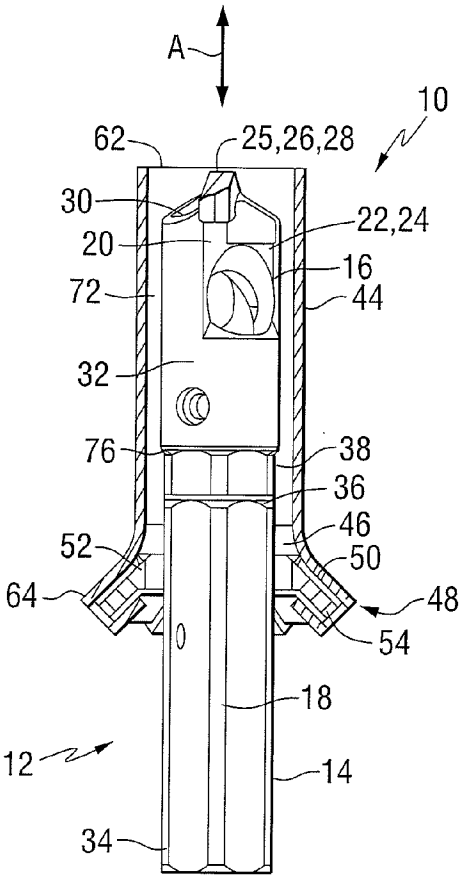
FIG. 4 is a cross-sectional view of the dust collecting device taken along lines A-A of FIG. 3.

As shown in FIG. 4, drill steel 14 comprises a hollow steel bar having a central passage 18, and roof drill bit 16 includes a passageway 20 open to the central passage 18 of drill steel 14. Vacuum passages or ports 22 and 24 are located around the periphery of roof drill bit 16 at about a 180 degree angle relative to each other and adjacent to cutting elements 25, 26 and 28 of roof drill bit 16 which may be similar to that disclosed in U.S. Pat. No. 6,315,064 to Massa, et al., which is incorporated herein by reference. As particularly shown in FIG. 1, these vacuum ports 22 and 24 are located at the axially forward end 30 of the elongate body 32 of the roof drill bit 16 in close proximity to cutting elements 25, 26 and 28 for drawing in the earth cuttings and/or rock dust. For drilling rock strata, cutting elements 25, 26 and 28 cut into the strata and the debris and/or cuttings, along with the rock dust, are drawn into the vacuum ports 22 and 24 and pass into the passageway 20 of roof drill bit 16 and through the central passage 18 and into the vacuum suction collection system (not shown).

Figure 2:
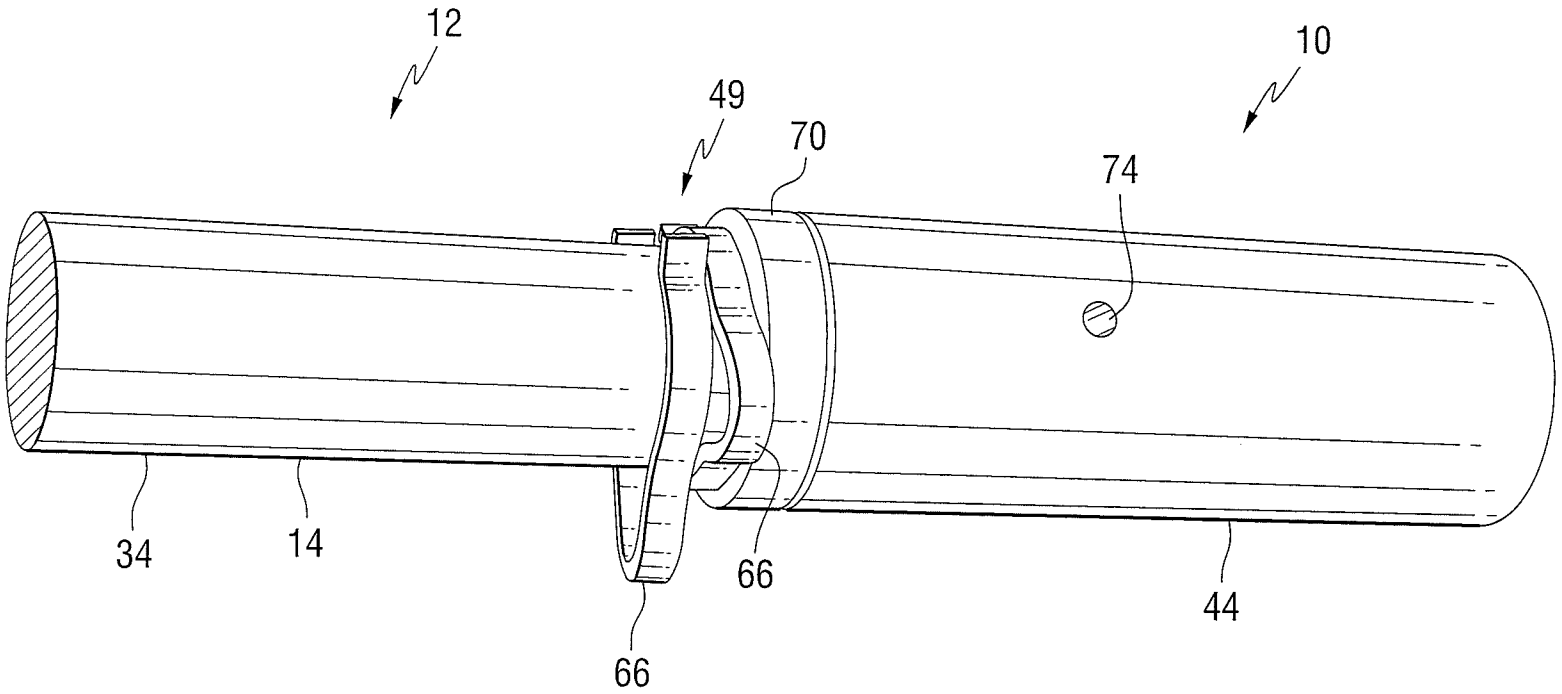
FIG. 2 is a photograph showing an elevation side view of the dust collecting device of FIG. 1 positioned over a roof drill bit.

As best shown in FIGS. 1 and 2, drill steel 14 essentially comprises an elongated shaft 34 having an outer periphery surface. With particular reference to FIG. 4, drill steel 14 has an axially forward end portion 36 with an interior surface which is of a hexagonal configuration, and roof drill bit 16 has a rearward end portion 38 having an interior surface which is of a hexagonal configuration structured and arranged for coupling with the hexagonal configuration of the forward end portion 36 of drill steel 14 in a known manner so that these components can rotate as an assembly during the drilling operation. The hexagonal configuration described herein is exemplary only and the invention may include other shapes and configurations as well.

The dust collecting device 10, in accordance with one aspect of the invention, will be explained with reference to FIGS. 3, 4 and 5. Dust collecting device 10 comprises cylinder member 44, which may be made of steel, a bushing 46, and mounting assembly 48 for mounting cylinder member 44 around the outer periphery surface of shaft 34 of drill steel 14. The length of dust collecting device may range from about 2 inches (50.8 mm) to about 6 inches (152.4 mm).

Figure 5:
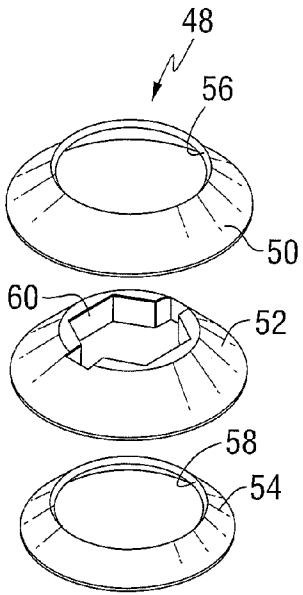
FIG. 5 is an exploded, enlarged view of a mounting assembly of the dust collecting device of FIG. 4.

As shown specifically in FIG. 5, mounting assembly 48 comprises top washer 50, rubber insert 52, and bottom washer 54. Top washer 50 and bottom washer 54 have circular inner surfaces 56, 58 respectively, whereas rubber insert 52 has an inner surface 60 with a hexagonal configuration similar to that of the axially forward end portion 36 of drill steel 14 and the rearward end portion 38 of the roof drill bit 16 so that the inner hexagonal surface 60 of rubber insert 52 can slide on the outer surface of drill steel 14 and engage the outer hexagonal surface of the hexagonal forward end portion 36 of drill steel 14, thereby limiting the axial movement of dust collecting device 10 on drill steel 14. Rubber insert 52 is designed to "grip" either a ⅞ inch hex or a ⅞ inch round drill steel tube since both are used in the industry. The washer 50 acts as a "bearing" surface when roof drill bit 16 and drill steel 14 are inserted into the mine roof and the mine roof pushes cylinder member 44 of mounting assembly 48 down along the shaft 34 of drill steel 14 and against the resistance of the rubber insert 52 (FIGS. 4 and 5) or clip 66 (FIG. 2). This "bearing" surface 56 of washer 50 allows cylinder member 44 and therefore dust collecting device 10 to remain stationary while drill steel 14 and drill bit 16 rotate and then enter the bore hole being drilled.

Still referring to FIG. 5, in some aspects of the invention, top washer 50 and bottom washer 54 may be made of, for example, brass and may act as bushings or bearing surfaces for allowing rotational movement of drill steel 14 and roof drill bit 16 relative to dust collecting device 10 and for allowing axial movement of dust collecting device 10 along drill steel 14.

Figure 3:
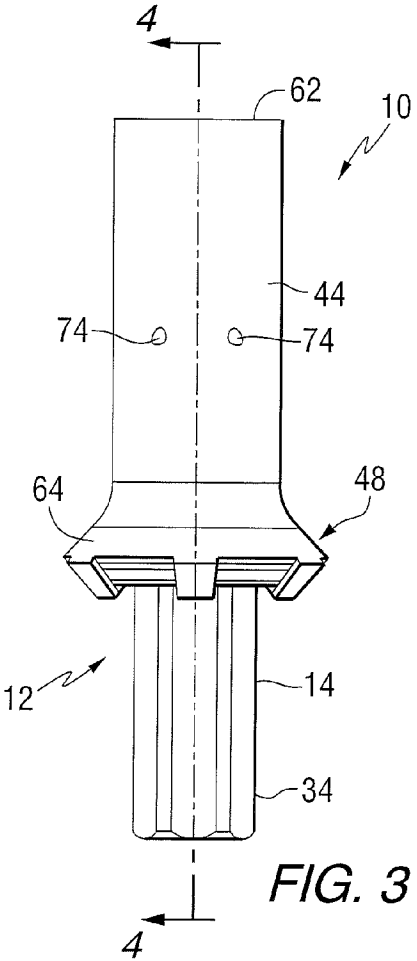
FIG. 3 is an elevation side view of a dust collecting device, in accordance with a further aspect of the invention.

In FIGS. 3 and 4, cylinder member 44 of dust collecting device 10 has an upper open end 62 and a bottom flared portion 64 for housing mounting assembly 48 and bushing 46 adjacent to mounting assembly 48.

With reference to FIGS. 1 and 2, dust collecting device 10 may be positioned along the body of drill steel 14 and held in this position by a mounting assembly 49 comprising clips 66, disk 68 (FIG. 1) and bushing 70. Clips 66 engage drill steel 14. During the drilling operation, dust collecting device 10 may be manually slid along drill steel 14 via disk 68 and disengagement of clips 66. Bushing 70, which may be, for example, brass, allows drill steel 14 and roof drill bit 16 to rotate as a unit during the drilling operation while dust collecting device 10 remains stationary on drill steel 14 similar to that described herein above for the operation of dust collecting device 10 of FIGS. 3-5.

In FIGS. 3, 4 and 5, dust collecting device 10 slides along drill steel 14 and is fixed into position via engagement of rubber insert 52 fitting snugly against the outer peripheral surface of shaft 34 of drill steel 14. When dust collecting device 10 is slid upwardly to enclose roof drill bit 16 as shown in FIGS. 3 and 4, rubber insert 52 fits snugly against the outer peripheral surface of shaft 34 of drill steel 14 to hold dust collecting device 10 in the position shown in FIG. 3. If dust collecting device 10 is to be moved from this position of FIG. 4, then dust collecting device 10 can manually be slid downwardly along shaft 34 of drill steel 14 whereby rubber insert 52 snugly fits around the outer periphery of shaft 34 of drill steel 14. The dust collecting device 10 of FIGS. 1 and 2 may operate or may be operated in a similar manner wherein clips 66 are disengaged from shaft 34 of drill steel 14 to allow device 10 to slide or be slid axially along shaft 34 of drill steel 14 and then engaged along shaft 34 of drill steel 14.

Referring particularly to FIG. 3, the outer diameter of roof drill bit 16 and the inner diameter of cylinder member 44 form an annular area 72. Annular area 72 may vary depending on the dimensions of the outer diameter of roof drill bit 16 and the inner diameter of cylinder member 44. In some aspects of the invention, the dimension of annular area 72 may range from about 0.062 inch (1.57 mm) to about 0.500 inch (12.70 mm). As shown in FIGS. 1, 2 and 3, the outer diameter of cylinder member 44 comprises several small apertures, one of which is designated as 74 in these figures. As bore holes are formed by roof drill bit 16, the generated dust will initially tend to accumulate in the annular area 72 of dust collecting device 10. As vacuum is applied through drill steel 14 and roof drill bit 16, outside air is drawn through apertures 74 of cylinder member 44 and into annular area 72. This stream of air picks up the dust created during the bore drilling operation. This air stream comprising dust and/or strata cuttings is then drawn into vacuum ports 22 and 24 of drill steel 14 and away from the bore hole being drilled. As previously described, during the dry drilling operation, cylinder member 44 of dust collecting device 10 is not inserted into the bore hole being drilled, but remains against the surface of the roof while the roof drill bit 16 and the drill steel 14 travel up into the bore hole.

An operation of dust collecting device 10 may be as follows: Initially, prior to roof tool 12 being operated for drilling a bore hole, dust collecting device 10 is positioned around roof drill bit 16 as shown in FIG. 4 and against the roof of a mine so that cylinder member 44 abuts the roof. Drill steel 14 and roof drill bit 16 are rotated as a unit to begin the drilling operation. Whatever rock dust is generated at this time is collected in the dust collecting device 10. The rock dust that flows down into annular area 72 is prevented from escaping into the atmosphere by bushing 46 and mounting assembly 48, and is suctioned upwardly out of annular area 72 and through vacuum ports 22 and 24 of roof drill bit 16 via the air stream created by small apertures 74 of cylinder member 44 and the vacuum suction collection system. As the depth of bore hole is increased via roof tool 12, the mine roof pushes dust collecting device 10 downwardly along drill steel 14 while drill steel 14 and roof drill bit 16 extend further up into the bore hole being drilled. During this time, rubber insert 52 of mounting assembly 48 (FIGS. 3-5) and clips 66 of mounting assembly 49 (FIGS. 1 and 2) resist but allow the sliding of dust collecting device 10 and dust collecting device 10 remains outside of the bore and against the mine roof. As the depth of the bore hole is increased, the strata cuttings and the rock dust are drawn through vacuum ports 22 and 24 by the vacuum collection system. When the dry drilling operation is completed, drill steel 14 and roof drill bit 16, as an assembly, are withdrawn from the bore hole. Dust collecting device 10 remains attached around roof drill bit 16 via either rubber insert 52 or clips 66 engaging drill steel 14. In some aspects of the invention, the dust collecting device 10 may be used to initially collect the rock dust being generated during the start of the dry drilling operation and the vacuum collection system may then be used to collect the strata cuttings and the rock dust as the depth of the bore hole is increased. In other aspects of the invention, the dust collecting device 10 and the vacuum collection system may be used simultaneously to collect the rock dust and the strata cuttings.

In addition to the dust collecting device 10 being used to collect or catch the rock dust that normally enters the mine atmosphere, rubber insert 52 of mounting assembly 48 which generally forms an interference fit with drill steel 17 and is generally used to control the sliding of mounting assembly 48 along drill steel 17 may also assist in reducing the noise level generated during the drilling operation. This noise reduction would be an additional benefit to the operator of the roof tool 12.

The implementation described above and other implementations are within the scope of the described invention and the following claims.

What is claimed is:

1. A roof tool, comprising:

a drill steel;

a roof drill bit connected to the drill steel for drilling a bolt bore hole in a mine roof, wherein the roof drill bit comprises at least one vacuum port; and a dust collecting device circumferentially disposed on the drill steel and the roof drill bit with the dust collecting device having a diameter greater than a diameter of the roof drill bit to allow the dust collecting device to engage the mine roof but not enter the bolt bore hole, the dust collecting device being constructed and arranged to collect and remove dust from the environment when drilling the bolt bore hole, wherein the dust collecting device comprises:

a cylinder member having an upper open end and a bottom flared portion at an opposing end of the cylinder member;

a bushing; and a mounting assembly adjacent to the bushing for mounting the dust collecting device on the drill steel and the roof drill bit, the mounting assembly configured to allow rotational movement of the drill steel and roof drill bit relative to the dust collecting device and to allow axial movement of the dust collecting device along the drill steel, wherein the bottom flared portion of the cylinder member houses the bushing and the mounting assembly, wherein an outer diameter of the roof drill bit and an inner diameter of the cylinder member form an annular area that extends continuously from the upper open end of the cylinder member to the bottom flared portion of the cylinder member, wherein the bushing and mounting assembly are configured to collect the dust in the annular area of the cylinder member and to prevent the dust from entering the bottom flared portion of the cylinder member.

2. The roof tool of claim 1, wherein the mounting assembly comprises a rubber insert constructed and arranged to allow but resist movement of the dust collecting device along the drill steel when drilling a bolt bore hole.

3. The roof tool of claim 2, wherein the mounting assembly further comprises at least two washers; and wherein the rubber insert is located between the at least two washers.

4. The roof tool of claim 1, wherein the cylinder member comprises at least one aperture for drawing in outside air.

* * * * *